US010512967B2

(12) United States Patent
Badent

(10) Patent No.: US 10,512,967 B2
(45) Date of Patent: Dec. 24, 2019

(54) APPARATUS AND METHOD FOR SETTING JOINING OR FUNCTIONAL ELEMENTS

(71) Applicant: TOX PRESSOTECHNIK GMBH & CO. KG, Weingarten (DE)

(72) Inventor: Michael Badent, Weingarten (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 457 days.

(21) Appl. No.: 15/244,377

(22) Filed: Aug. 23, 2016

(65) Prior Publication Data

US 2017/0001236 A1 Jan. 5, 2017

Related U.S. Application Data

(63) Continuation of application No. PCT/EP2014/078493, filed on Dec. 18, 2014.

(30) Foreign Application Priority Data

Feb. 28, 2014 (DE) ..... 10 2014 002 684

(51) Int. Cl.
*B21J 15/36* (2006.01)
*B21J 15/02* (2006.01)
*B21J 15/10* (2006.01)

(52) U.S. Cl.
CPC ..... *B21J 15/36* (2013.01); *B21J 15/025* (2013.01); *B21J 15/10* (2013.01)

(58) Field of Classification Search
CPC ..... B21J 15/36; B21J 15/025; B21J 15/10; Y10T 29/49943; Y10T 29/49956; Y10T 29/5118; Y10T 29/5377
See application file for complete search history.

(56) References Cited

U.S. PATENT DOCUMENTS

2012/0260491 A1 10/2012 Draht et al.
2013/0139370 A1 6/2013 Bloecher

FOREIGN PATENT DOCUMENTS

DE 92 15 475 U1 1/1993
DE 103 19 411 A1 11/2004
(Continued)

OTHER PUBLICATIONS

Reuschenbach DE 2011116654 English Translation (Year: 2013).*
(Continued)

*Primary Examiner* — Jason L Vaughan
*Assistant Examiner* — Amanda Kreiling
(74) *Attorney, Agent, or Firm* — Burr & Brown, PLLC

(57) ABSTRACT

An apparatus for setting a joining or functional element comprising a mount, a punch disposed on the mount, a hold-down device surrounding the punch, a die, which is disposed on the mount and lies coaxially opposite the punch, a drive unit for effecting a relative movement of punch and die, and a control unit. According to the invention, the drive unit moves the die relative to the mount. Furthermore, a loading device for providing a loading stroke of the hold-down device for loading of a joining or functional element with prespecified stroke path of the hold-down device, and a force-exerting member, are provided, in order to, in the setting of a joining or functional element, press the hold-down device, in a pressure phase differing from the loading stroke, with predefined compressive force against a workpiece. Furthermore, a method for setting a joining or functional element is proposed.

13 Claims, 6 Drawing Sheets

(56) References Cited

FOREIGN PATENT DOCUMENTS

| | | | | | |
|---|---|---|---|---|---|
| DE | 10319411 | A1 * | 11/2004 | ..... | B21J 15/025 |
| DE | 10 2004 015 568 | A1 | 10/2005 | | |
| DE | 10 2009 049 616 | A1 | 4/2011 | | |
| DE | 10 2010 027 195 | A1 | 1/2012 | | |
| DE | 10 2011 116 654 | A1 | 4/2013 | | |

OTHER PUBLICATIONS

English Translation DE10319411A1 (Year: 2004).*
International Preliminary Report on Patentability (PCT/EP2014/078493) dated Sep. 15, 2016.
German Search Report (Application No. 10 2014 002 684.1) dated Oct. 10, 2014.
International Search Report and Written Opinion (Application No. PCT/EP2014/078493) dated Mar. 31, 2015.

* cited by examiner

APPARATUS AND METHOD FOR SETTING JOINING OR FUNCTIONAL ELEMENTS

CROSS REFERENCE TO RELATED APPLICATIONS

This application is a continuation of International Application No. PCT/EP2014/078493 filed Dec. 18, 2014, which designated the United States, and claims the benefit under 35 USC § 119(a)-(d) of German Application No. 10 2014 002 684.1 filed Feb. 28, 2014, the entireties of which are incorporated herein by reference.

FIELD OF THE INVENTION

The present invention relates to an apparatus for setting a joining or functional element and to a method for setting a joining or functional element.

BACKGROUND OF THE INVENTION

Methods and apparatuses for setting a joining or functional element, for example, for punch riveting, have already become known in a variety of embodiments. In these, a punch is moved by means of a drive unit for setting, for example, a rivet against a coaxially opposite die.

For the drive, hydraulic or hydropneumatic drives or electromotive drives having a spindle drive are regularly used.

In many embodiments, the punch and the die are disposed on a mount, which is C-shaped.

As a result of the structural specifications of the apparatus, access to a workpiece, in particular, when this is fixed, for example, a fixed automotive body, and a prespecified joining direction in relation to a workpiece surface has to be maintained, is limited.

SUMMARY OF THE INVENTION

The object of the present invention is to provide an apparatus and a method for setting a joining or functional element, whereby improved access to setting points on workpieces, combined with constant joining or setting quality, is enabled.

The present invention is based on an apparatus for setting a joining or functional element, which apparatus comprises the following:

A mount, a punch disposed on the mount, a hold-down device surrounding the punch, a die disposed on the mount and lying coaxially opposite the punch, a drive unit for effecting a relative movement of punch and die, and a control unit. The essence of the present invention now lies in the fact that the drive unit moves the die relative to the mount, and that a loading device for providing a loading stroke of the hold-down device for loading of a joining or functional element with prespecified stroke path of the hold-down device is provided. Furthermore, a force-exerting member is present in order to, in the setting of a joining or functional element, press the hold-down device, in a pressure phase differing from the loading stroke, with predefined compressive force against a workpiece.

Since the die is movable relative to the mount, no drive unit which must provide a compressive force for setting a joining or functional element is necessary on the punch. Hence the punch-side part of the apparatus has a comparatively low spatial requirement and can thus be applied to workpiece surfaces in which the room for movement would not be sufficient to place a driven punch with drive unit.

In certain cases the joining direction of a joining element is immaterial, whereas there are cases in which only one joining direction is technically feasible and sensible, for instance in the setting of a self-piercing semitubular rivet, in which it matters on which side a material composite remains closed, i.e. is not penetrated by a self-piercing semitubular rivet. In the case of functional elements, it is predominantly the case that one setting direction has to be maintained, for example, when a functional element having a fastening element like a threaded pin is inserted into a structural component. This threaded pin will sensibly be able to be used only on one side of and at one point on the structural component.

As a result of a loading device for realizing a loading operation and a force-exerting member which is responsible for, during the setting of a joining and functional element, pressing the hold-down device in a predefined manner against the workpiece, a connection quality which is appropriate in comparison to an apparatus in which the punch is driven together with a hold-down device can be obtained.

In the loading operation, the hold-down device can in the most extreme case be subjected to no force at all, i.e. can be moved along forcelessly so to speak, or else can make only a comparatively low counterforce necessary in this movement for the performance of the loading stroke.

The mount can be, for example, a C-frame, as is known in punch-side-driven punch riveting apparatuses from the prior art. Preferably, the elements of the apparatus for setting a joining and functional element are configured such that they are mountable on a conventional C-frame, known from the prior art, for a punch-side drive.

In a particularly preferred embodiment of the present invention, the compressive force of the hold-down device in the pressure phase is at least 2, 3, 4, 5 times higher, or higher still, than a compressive force on the hold-down device in the course of the loading stroke on a loading stroke path.

The compressive force of the hold-down device in the pressure phase and/or in the course of the loading stroke can be provided via spring means. For the loading stroke, a spring with comparatively low spring force can be used, wherein, in the pressure phase, spring assemblies which exert a multiple of compressive force on the hold-down device can be used.

Preferably, the spring force is realized in the course of the loading stroke and in the pressure phase via different springs.

In a further advantageous embodiment of the present invention, the compressive force of the hold-down device in the course of the loading stroke is provided via a pneumatic force-exerting mechanism. High flexibility in the adjustment of the force action is thereby acquired by appropriate pneumatic actuation of the force-exerting mechanism for the hold-down device. As the force-exerting mechanism, one or more pneumatic cylinders, for example, is conceivable. The force generation during the pressure phase can likewise be realized pneumatically. A hydraulic force application is also conceivable.

Furthermore, it is preferred if a second drive device is provided for an independent separate movement of the hold-down device. As a result, via the second drive device, a predefined loading stroke of the hold-down device can be realized in order to position a joining or functional element in front of the punch for a setting operation.

Where a joining or functional element is inserted into a fixed workpiece, it is further advantageous if a compensating member is provided for the movement of the mount in the direction of a joining or setting axis of the apparatus. For instance, the mount is arranged displaceably at its point of attachment, for example, to a robot via a slide with, for example, pneumatic weight compensation. A further option can also consist in creating a compensation, given a moving die and a fixed workpiece, by virtue of the fact that the compensating movement is provided by a robot system on which the mount is fitted.

For instance, a robot system for providing a position compensation performs a synchronized movement calculated, in particular, on several axes.

The pneumatic weight compensation on a slide at a point of attachment of the apparatus can be regulated, for example, in dependence on the spatial position.

Since the die is movable relative to the mount, the punch can be fixedly connected to the mount, whereby the design for the punch is simple.

Preferably, the drive unit is disposed on the mount on the die side, whereby the die can be arranged in a constructively simple manner such that it is movable relative to the mount.

In order to acquire a defined guidance of the hold-down device on the mount, it is further proposed that the hold-down device is guided movably on the mount via at least one guide column, preferably two guide columns.

The hold-down device can be designed such that it is movable via a pneumatically actuable piston. In this context, it is additionally preferred if the at least one guide column comprises a piston of a pneumatic drive, which piston moves in a pneumatic cylinder. The guide mechanism and drive of the hold-down device can thus be compactly combined in design terms.

For the loading of a joining or functional element, it is further proposed that the control unit is designed to move the hold-down device along the punch in the direction of the die into an extended position to the point where a loading opening for feeding of a joining or functional element, for example, a rivet, from a feed channel is freed.

In order to enable a comparatively rapid setting operation, it is further proposed that the control unit is configured so as to apply the hold-down device, in an extended position, to a workpiece. It is here necessary, however, that appropriate space is available to position the apparatus with extended hold-down device on the workpiece. In particular, the mount of the apparatus can be more compactly constructed if a loading operation is firstly concluded before the apparatus is advanced, with returned hold-down device, up to a workpiece.

In order to halt a defined movement of the hold-down device in the course of a loading phase and/or in the pressure phase, it is further proposed that the control unit is such that the die can be moved by means of the drive unit up to a workpiece and is then further movable toward the hold-down device retreating on the other, opposite side of the workpiece. In particular, the loading operation can hence be jointly incorporated into this motional sequence if the hold-down device in the extended loading state is moved back, together with the die, to the point where the pressure phase begins and the actual setting operation, for example, of the joining element, takes place. The return travel of the loading stroke is here preferably realized with a comparatively small force which is significantly smaller than the compressive force in the setting operation.

A retreat of the hold-down device as the die is advanced, with workpiece resting against both hold-down device and die, can be realized by the control unit in such a way that the hold-down device retreats in a definedly driven manner, i.e. with a prespecifiable counterforce, in particular, a counterforce controllable by a control unit.

The force action of the hold-down device can be effected, however, both in the pressure phase and in the loading phase, via spring means.

In order to minimize the influence of inertia forces on a structural component, it is further proposed to configure the control unit in such a way that, during a setting operation or shortly before commencement of the setting operation, a velocity of the die is reduced.

In a method for setting a joining or functional element with an apparatus comprising a mount, a punch disposed on the mount, a hold-down device surrounding the punch, a die disposed on the mount and lying coaxially opposite the punch, and a drive unit, the present invention lies in the fact that the die is moved by means of the drive unit, and that, independently thereof, the hold-down device executes a loading stroke for loading of a joining or functional element with prespecified stroke path of the hold-down device and, in the course of a differing pressure phase, the hold-down device is pressed against the workpiece with prespecified compressive force in a setting operation. Preferably, for this purpose, the hold-down device is separately driven in order to be able, in particular, to execute the loading stroke.

Preferably, the hold-down device is moved along the punch in the direction of the die into a loading position for the reception of a joining or functional element, in particular, a rivet, in an extended state. This is advantageously realized with the separate drive device.

In a further advantageous embodiment of the method, it is further proposed that the hold-down device, in a state extended along the punch in the direction of the die, is brought to bear against a workpiece, and the die, in the applied state, is moved up to the workpiece or the hold-down device, and the die hereupon forces back the hold-down device with workpiece for a setting operation of the rivet, for example. When the hold-down device is forced back, the die travels toward the, in particular, rigidly arranged, punch, which comes forward relative to the hold-down device and hereupon in the last phase punches the rivet, for example, into the workpiece.

In the case of a fixed workpiece, it is necessary that the mount performs a compensating movement, for example, through a counter movement of a robot on which the mount is disposed, or through an appropriate compensating apparatus at a point of attachment of the mount to a structural unit on which the mount is fitted.

In order to enable the realization of a mount with smallest possible installation space, it is further proposed that the hold-down device, after the loading operation with a rivet, for example, is moved into the retracted state. Hence this loading stroke does not have to be provided for in the dimensioning of the mount. After this, the hold-down device can be brought to bear against a workpiece, and the die, in the applied state, can be moved up to the workpiece or the hold-down device, whereupon the die, in the pressure phase, can force back the hold-down device with the workpiece during a setting operation of the rivet, for example.

BRIEF DESCRIPTION OF THE DRAWINGS

Several illustrative embodiments of the present invention are represented in the drawings and are explained more closely below, specifying further advantages and details, wherein.

DETAILED DESCRIPTION OF THE INVENTION

Figure 1:
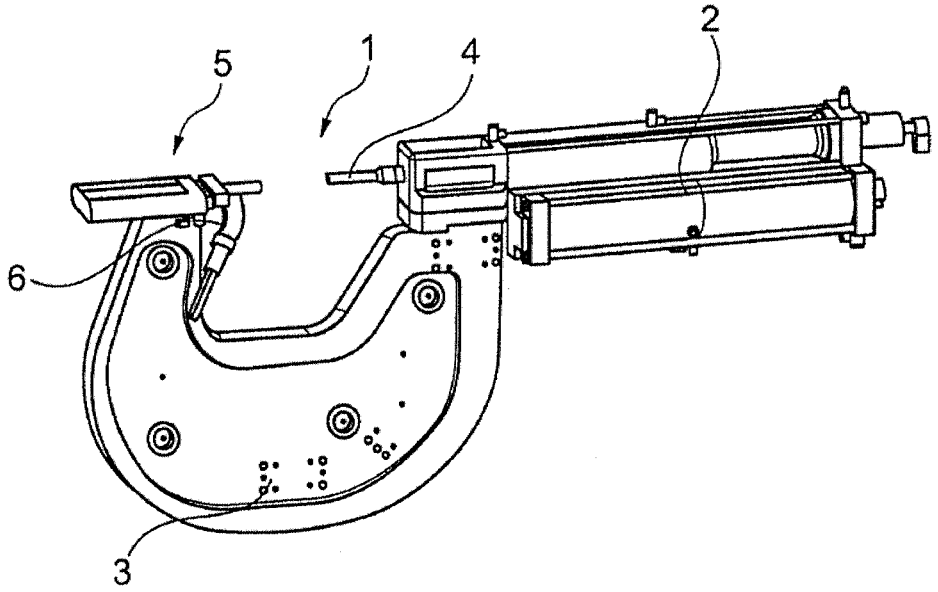
FIG. 1 shows in a perspective representation a joining gripper with die-side drive.

In FIG. 1 is represented a joining gripper 1 for the, in particular, riveting of structural components, comprising a drive unit 2, a mount 3, a die 4, a setting head 5, and a rivet feed unit 6. With the drive unit 2, a die 4 is axially driven.

The joining gripper can be used to set self-piercing semitubular rivets, solid punch rivets, clinch rivets, specified functional elements, resistance welding elements with and without a hold-down force of a hold-down device.

Figure 2:
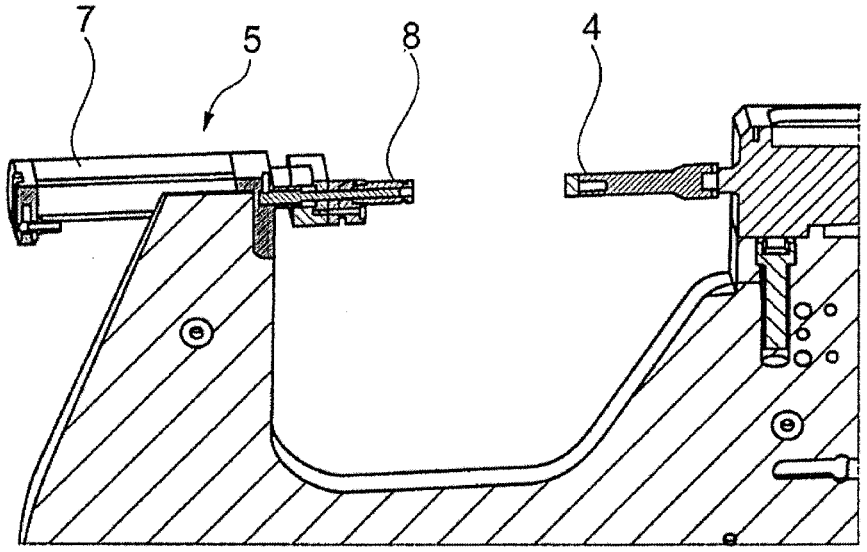
FIG. 2 shows in perspective representation a detail of the joining gripper according to FIG. 1 partially sectioned in the punch and die region.
Figure 3:
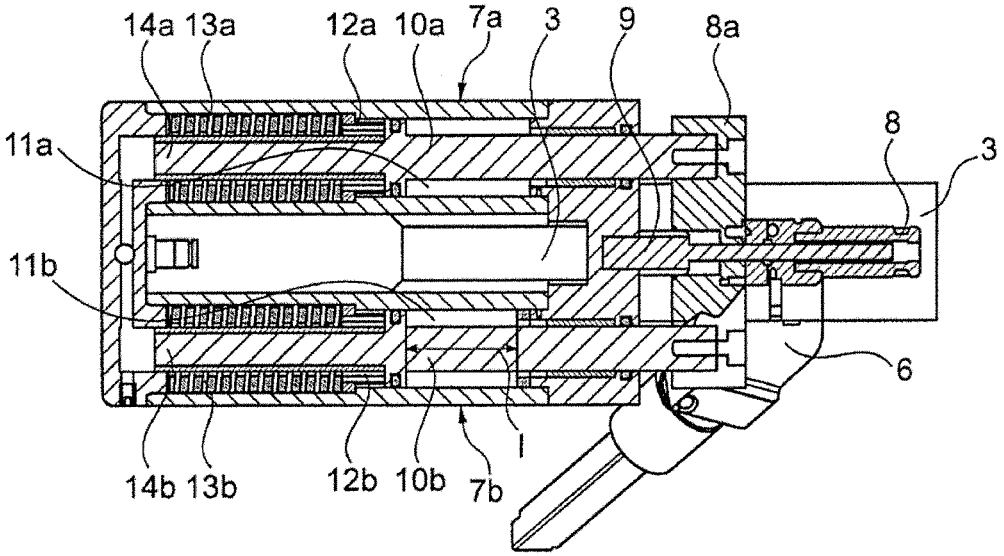
FIG. 3 shows in a sectional view a punch-side setting head according to the joining gripper according to FIGS. 1 and 2.

In FIGS. 2 and 3, more details of the joining gripper, in particular, of the setting head 5, are visible.

The setting head 5 comprises a pneumatic device 7 having two pneumatic cylinders 7*a*, 7*b*, a hold-down device 8 and a punch 9. The pneumatic cylinders 7*a* and 7*b* have pistons 10*a*, 10*b*, which at the same time form guide columns for the hold-down device 8. The punch 9 is fixedly connected to the mount 3.

The movement involved in the setting of a joining element is thus effected by the movement of the die 4. Over a length 1 of a pneumatic pressure chamber 11*a*, 11*b*, the pistons 10*a*, 10*b* or columns 10*a*, 10*b* can be extended and retracted in a pneumatically controlled manner, whereby the hold-down device 8 can be extended and retracted on a hold-down device receiving fixture 8*a* connected to the pistons 10*a*, 10*b* or columns 10*a*, 10*b*.

In the retracted state, the pistons 10*a*, 10*b* lie respectively against a stop 12*a*, 12*b*. The particularity here is that the respective stop 12*a*, 12*b* is spring-loaded by a pressure spring 13*a*, 13*b*, behind the stop 12*a*, 12*b*. In the illustrative embodiment, the pressure springs 13*a*, 13*b* enclose an extension 14*a*, 14*b* of the pistons 10*a*, 10*b*. For the setting operation is there is hence realized a hold-down device function, in which the hold-down force is generated by the pressure springs 13*a*, 13*b* once the hold-down device is so far retreated in relation to the pneumatic cylinders 7*a* and 7*b* that the pistons 10*a*, 10*b* run up against the respective stop 12*a*, 12*b* and then the respective stop 12*a*, 12*b* is forced back counter to the spring force.

As a result, the punch 9 comes forward in the hold-down device 8 and sets a joining element into a corresponding workpiece (not represented in FIG. 3).

A joining element, for example, a rivet, is fed to in front of the punch 9 by means of the rivet feed unit 6. The rivet is then held in front of the punch 9 in the hold-down device 8. In a setting operation of the rivets into a workpiece, the fixed punch acts as a counterstay for a rivet.

In FIGS. 4*a* to 4*f* and 5*a* to 5*f*, two variants for the setting of a rivet are subsequently illustrated.

Figure 4A:
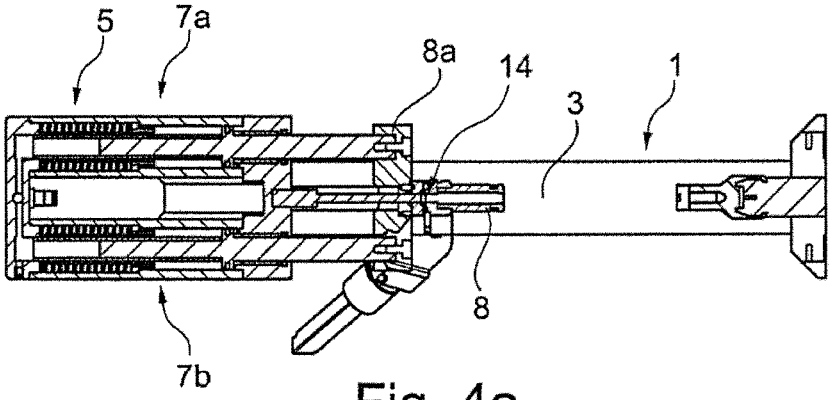
FIGS. 4*a* to 4*f* show in a schematic sectional view a loading and setting operation of the joining gripper in relation to a workpiece.

In a first variant, the pneumatic cylinders 7*a*, 7*b* are extended, whereby the setting head 5 is in a loading position. In this position, a rivet is loaded onto the site identified with the arrow 14. The hold-down device 8 on the hold-down device receiving fixture 8*a* is fully extended (FIG. 4*a*).

Figure 4B:
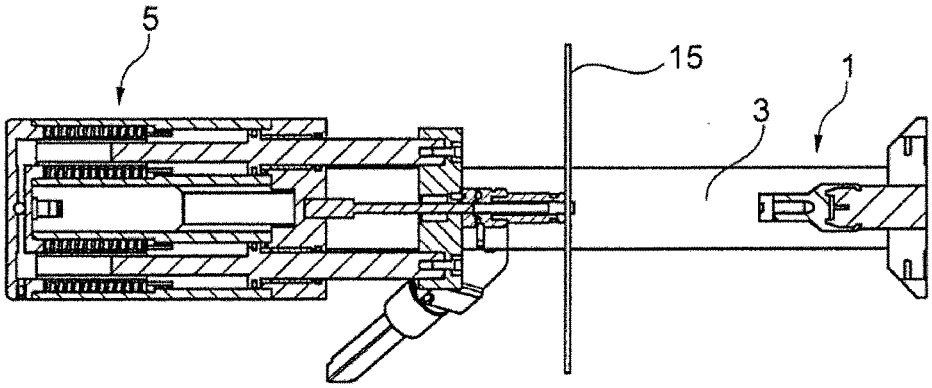
Figure 4C:
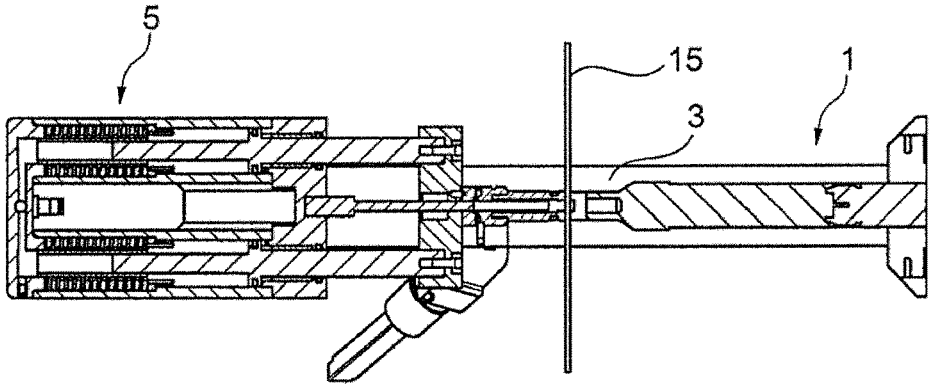

In this position with extended hold-down device 8, the gripper is applied with the hold-down device to a structural component 15 and the drive unit 2 (see FIG. 1) commences a stroke and hereupon extends the die toward the workpiece 15 (see FIGS. 4*b* and 4*c*).

When the die 4 meets the structural component 15, the pneumatic cylinders 7*a*, 7*b* are forced back and the loading stroke for a rivet begins. At the same time, the joining gripper is transported relative to the structural component if this is a fixed structural component. For this, transport means which are suitable in relation to the joining gripper 1 are necessary.

In the loading stroke a comparatively small hold-down force is in play, that is to say the force provided by the pneumatic cylinders 7*a*, 7*b* is comparatively small. This force could also be completely switched off. In the loading stroke, the punch closes the rivet to the fore in the hold-down device 8 when the latter is retracted.

Figure 4D:
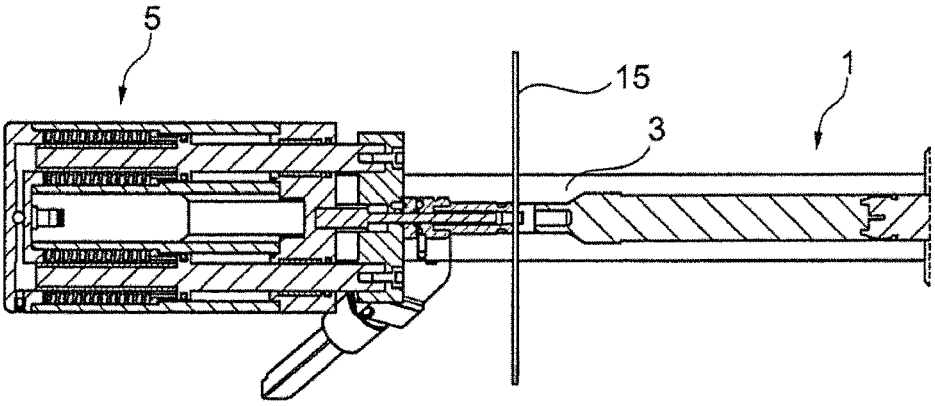
Figure 4E:
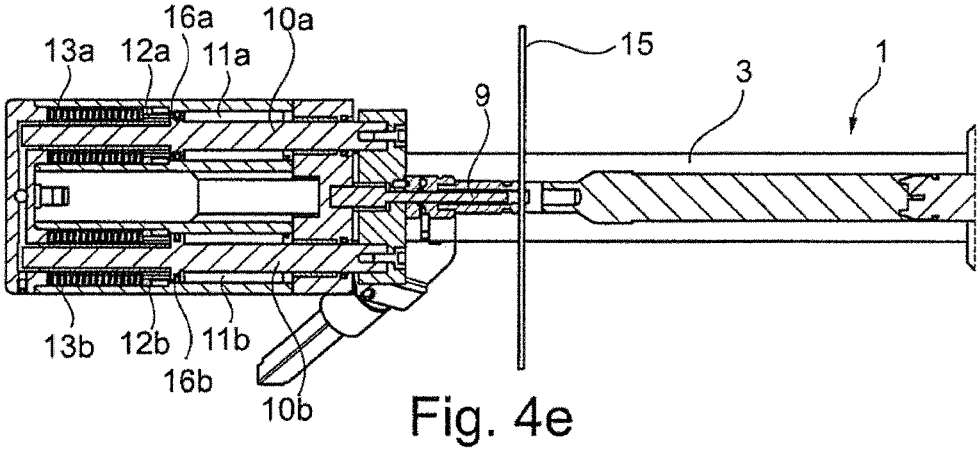

In FIG. 4*d*, the loading stroke is just concluded. A stop 16*a*, 16*b* on the respective piston 10*a*, 10*b* is then seated on the stop 12*a*, 12*b* at the end of the pneumatic pressure chamber 11*a*, 11*b*. Upon further transportation of the die 4, a hold-down force induced by the springs 13*a*, 13*b* now begins to act. The onset of the hold-down force can take place before or after the mounting of the rivet on the workpiece.

Figure 4F:
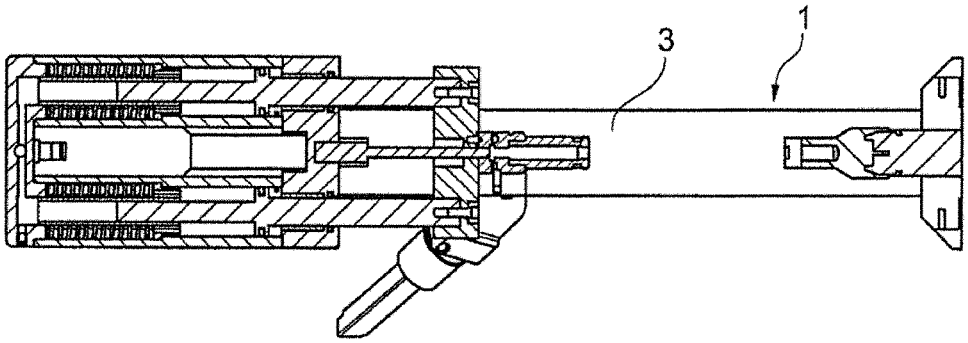

The rivet is pressed in (F 4*e*) and all movements revert to the starting position (FIG. 4*f*).

A new rivet is delivered and the loading stroke can start anew according to FIG. 4*b*.

This procedure with respect to the setting of a rivet has the advantage that a rapid process is possible, since a loading stroke is a constituent part of the setting operation and, at the same time, the reloading of a next rivet can take place immediately after the lifting of the hold-down device 8 from a structural component.

However, the travel distance for the loading stroke must be included in a measure for the mount, in particular, of the C-shaped mount.

Figure 5A:
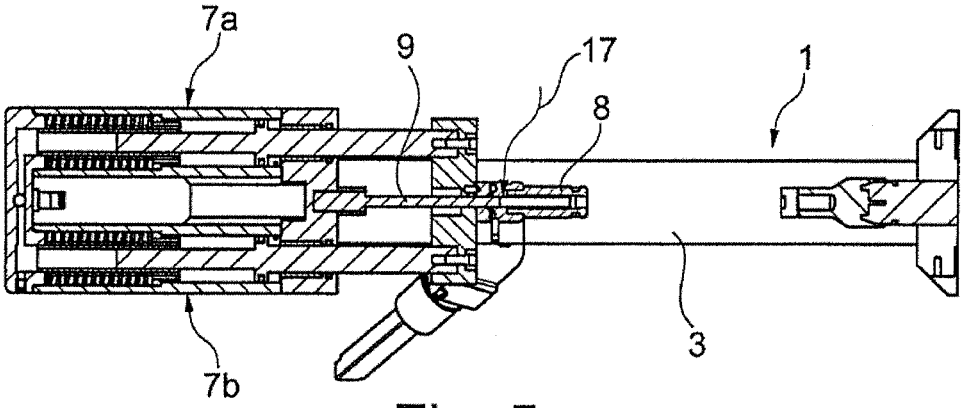
FIGS. 5*a* to 5*f* show an operation corresponding to FIGS. 4*a* to 4*f*, yet with alternative movement variant for the loading of a joining element.
Figure 5B:
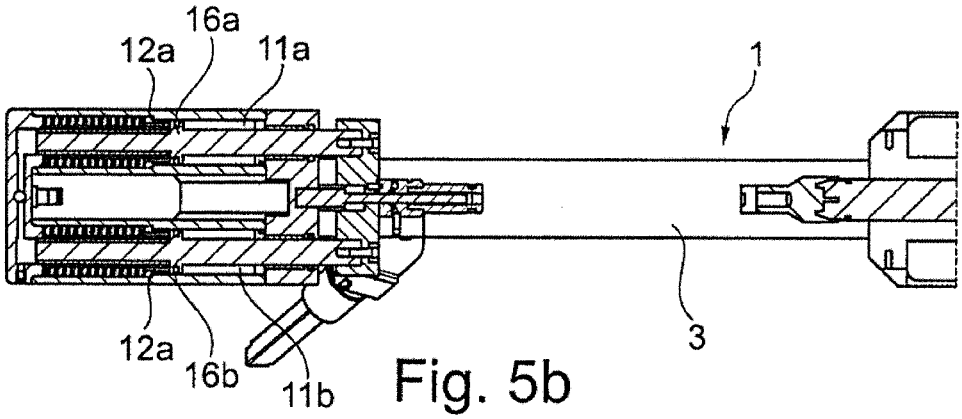
Figure 5C:
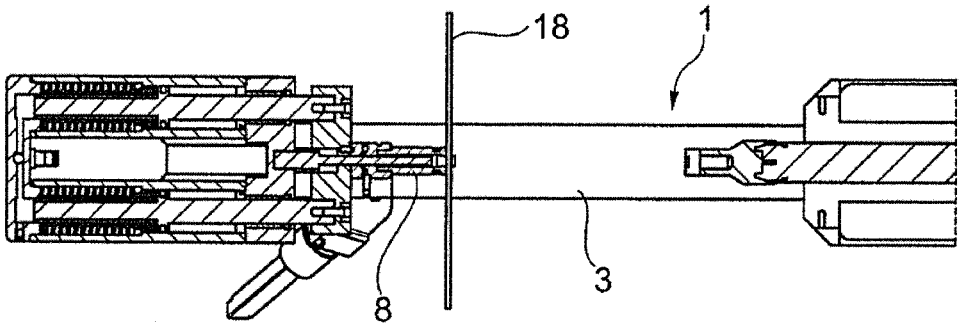

In FIGS. 5*a* and 5*b* is displayed a variant in which specifically this loading stroke can be saved in the measurement of the C-shaped mount.

Accordingly, the setting of a rivet in this variant looks as follows:

The pneumatic cylinders 7*a*, 7*b* are extended in order thus to bring the setting head 5, in particular, the hold-down device 8, in relation to the punch 9 into a loading position. In FIG. 5*a* is represented the loading position in which a rivet is loaded into the position according to the arrow 17.

By the pneumatic cylinders 7*a*, 7*b*, a return stroke is now realized of the hold-down device 8, which return stroke corresponds to the loading stroke and ends through impingement of the stops 16*a*, 16*b* on the stops 12*a*, 12*b* at the respective end of the pneumatic pressure chamber 11*a*, 11*b* (see FIG. 5*b*).

Figure 5D:
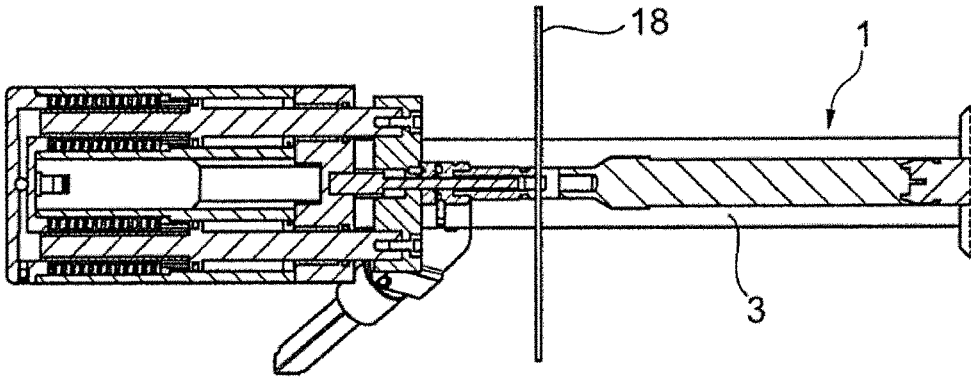
Figure 5E:
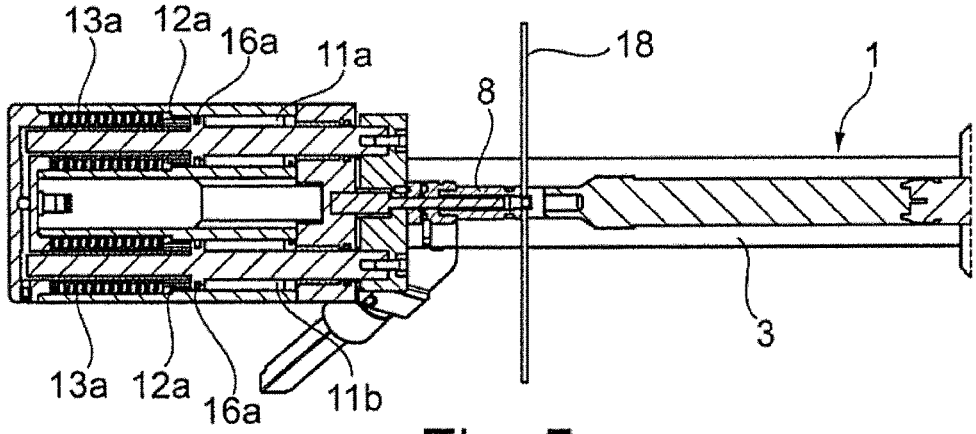
Figure 5F:
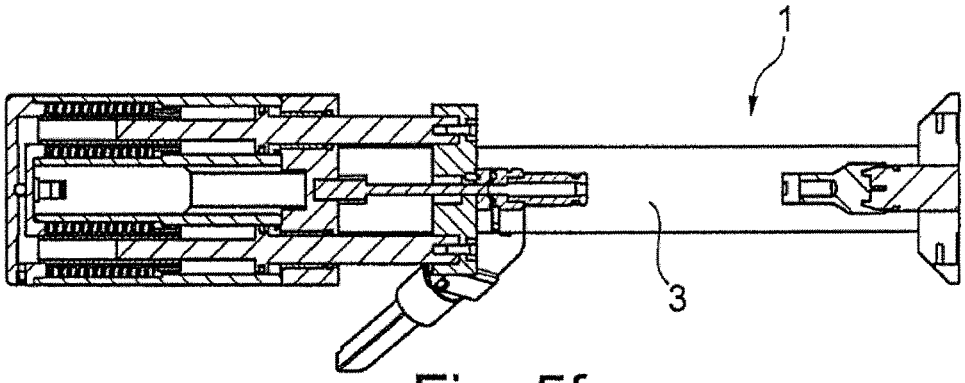

From now on, the joining gripper 1 is applied to a structural component 18 by, for example, a robot with the hold-down device 8, and the drive unit 2 commences a working stroke, whereby the die 4 is extended toward the structural component 18 (see FIG. 5*d*).

When the die 4 meets the structural component 18, the stops 16*a*, 16*b* of the pistons 10*a*, 10*b* of the pneumatic cylinders 7*a*, 7*b* are pressed against the stops 12*a*, 12*b* at the end of the pneumatic pressure chambers 11*a*, 11*b*, whereby, upon further transportation, the pressure springs 13*a*, 13*b* are compressed and provide the hold-down force for the hold-down device 8. When the hold-down device 8 is pushed back, the punch 9 comes further and further forward, whereby the rivet, with mounted punch on the rivet, is pressed into the structural component 18 (see FIG. 5*e*).

The onset of the hold-down force can take place before or after the mounting of the rivets.

Following conclusion of the operation, all movements revert to the starting position, whereupon the joining gripper is moved away from the workpiece in order to enable extension of the hold-down device 8 into a loading position.

Then a new rivet can be delivered. The operation begins anew.

Since the loading operation takes place remote from the structural component 18, the loading stroke does not have to impact on the structure, in particular, of a C-shaped mount, as represented in FIG. 1.

Since the joining gripper 1, however, must be freely moved for the reloading, this operation of setting a rivet, in comparison to the operation according to FIGS. 4*a* to 4*f*, is associated with a larger cycle time for the setting of the rivet.

Also in this case of the setting of a rivet, it is necessary, after the mounting of the hold-down device on the structural component 18, to compensate for the hold-down device 18 being forced back by the approaching or counterpressing die 4, with a view to a securement of the mount on another structure.

If the joining gripper is fitted on a robot, the robot can in principle also provide this compensating movement.

REFERENCE SYMBOL LIST

1 joining gripper
2 drive unit
3 mount
4 die
5 setting head
6 rivet feed unit
7 pneumatic device
7*a* pneumatic cylinder
7*b* pneumatic cylinder
8 hold-down device
8*a* hold-down device receiving fixture
9 punch
10*a* piston
10*b* piston
11*a* pneumatic pressure chamber
11*b* pneumatic pressure chamber
12*a* stop
12*b* stop
13*a* pressure spring
13*b* pressure spring
14 arrow
15 structural component
16*a* stop
16*b* stop
17 arrow
18 structural component

The invention claimed is:

1. An apparatus for setting a joining or functional element, comprising:

a mount;

a punch disposed on the mount;

a hold-down device surrounding the punch;

a die disposed on the mount and lying coaxially opposite the punch;

a drive unit that effects a relative movement of punch and die and which moves the die relative to the mount;

a control unit;

a loading device that provides a loading stroke of the hold-down device to load a joining or functional element with a prespecified stroke path of the hold-down device; and a force-exerting member that presses the hold-down device against a workpiece in a pressure phase that is different from the loading stroke with a predefined compressive force during a setting operation of a joining or functional element;

wherein a compressive force of the hold-down device during the loading stroke is provided via a pneumatic force-exerting mechanism;

wherein the hold-down device moves in a guided manner on the mount via at least one guide column on the mount; and wherein the at least one guide column comprises a piston of a pneumatic drive that moves in a pneumatic cylinder.

2. The apparatus as claimed in claim 1, wherein the compressive force of the hold-down device in the pressure phase is at least two times higher than the compressive force on the hold-down device during the loading stroke on the loading stroke path.

3. The apparatus as claimed in claim 1, wherein the compressive force of the hold-down device in the pressure phase is provided via a spring.

4. The apparatus as claimed in claim 1, further comprising a second drive device for an independent separate movement of the hold-down device.

5. The apparatus as claimed in claim 1, further comprising a compensating member for the movement of the mount in the direction of a setting axis of the apparatus.

6. The apparatus as claimed in claim 1, wherein the punch is fixedly connected to the mount.

7. The apparatus as claimed in claim 1, wherein the drive unit is disposed on the mount on a die side.

8. The apparatus as claimed in claim 1, wherein the hold-down device moves via the piston, which is pneumatically activated.

9. The apparatus as claimed in claim 1, wherein the control unit moves the hold-down device along the punch in the direction of the die into an extended position to the point where a loading opening for feeding of a joining or functional element from a feed channel is freed.

10. The apparatus as claimed in claim 1, wherein the control unit is configured to apply the hold-down device, in an extended position, to a workpiece.

11. The apparatus as claimed in claim 1, wherein the control unit is configured such that the die moves by means of the drive unit up to a workpiece, and is further movable toward the hold-down device retreating on an other, opposite side of a workpiece.

12. The apparatus as claimed in claim 1, wherein the control unit is configured to make the hold-down device retreat over a driven length when the die moves relative to the punch and the hold-down device under a force influence of the die on the hold-down device.

13. The apparatus as claimed in claim 1, wherein the control unit is configured to reduce a velocity of the die during the setting operation or shortly before commencement of the setting operation.

* * * * *